US007828179B2

(12) United States Patent
Sprovieri

(10) Patent No.: US 7,828,179 B2
(45) Date of Patent: Nov. 9, 2010

(54) COLLAPSIBLE GARMENT HANGER

(75) Inventor: Roberto Sprovieri, 50 Macintosh Blvd., Concord, Ontario (CA) L4K 4P3

(73) Assignee: Roberto Sprovieri, Condord, Ontario ( * ) Notice: Subject to any disclaimer, the term of this patent is extended or adjusted under 35 U.S.C. 154(b) by 62 days.

(21) Appl. No.: 12/247,611

(22) Filed: Oct. 8, 2008

(65) Prior Publication Data

US 2009/0127298 A1 May 21, 2009

(30) Foreign Application Priority Data

Oct. 9, 2007 (CA) ..... 2606347

(51) Int. Cl.
*A41D 27/22* (2006.01)

(52) U.S. Cl. ..... 223/94; 223/85

(58) Field of Classification Search ..... 233/85, 233/89, 90, 94; 211/85.3, 118
See application file for complete search history.

(56) References Cited

U.S. PATENT DOCUMENTS

| | | | | |
|---|---|---|---|---|
| 2,137,700 | A | 11/1938 | Reehl | |
| 2,728,499 | A | 12/1955 | Mueller | |
| 2,926,823 | A | 3/1960 | Weiser | |
| 3,315,854 | A * | 4/1967 | Glisson | 223/94 |
| 3,531,028 | A | 9/1970 | Vazquez | |
| 4,117,960 | A * | 10/1978 | Bengsch et al. | 223/94 |
| 4,227,632 | A | 10/1980 | Collis | |
| 4,231,499 | A * | 11/1980 | Smith | 223/94 |
| D271,927 | S | 12/1983 | Payant | |
| 4,813,581 | A | 3/1989 | LaMont | |
| 5,590,823 | A | 1/1997 | Lunde | |
| 5,826,759 | A * | 10/1998 | Ohsugi | 223/85 |
| 5,979,721 | A | 11/1999 | Curtis | |
| 6,540,121 | B1 | 4/2003 | Harvey | |
| 7,036,696 | B2 * | 5/2006 | Lam | 223/94 |

FOREIGN PATENT DOCUMENTS

| | | | |
|---|---|---|---|
| DE | 19860605 | A1 * | 7/2000 |
| FR | 2775174 | A1 * | 8/1999 |
| JP | 2007151784 | A * | 6/2007 |

* cited by examiner

*Primary Examiner*—Gary L Welch
*Assistant Examiner*—Nathan E Durham
(74) *Attorney, Agent, or Firm*—Ivor Hughes; Neil Hughes; Marcelo Sarkis

(57) ABSTRACT

A collapsible garment hanger comprising a central portion and two garment supporting members, where the central portion has a casing, enclosing a u-shaped top member engaging and operating the garment supporting members.

11 Claims, 14 Drawing Sheets

COLLAPSIBLE GARMENT HANGER

FIELD OF THE INVENTION

The present invention generally relates to a collapsible garment hanger. More specifically, the present invention relates to a collapsible garment hanger adapted to be inserted and removed from a garment and in a preferred embodiment by using a single hand.

BACKGROUND OF THE INVENTION

Collapsible garment hangers are well known. Many individuals have attempted to make an easy to use and affordable type of hanger for mass production and consumption. Several designs have been patented as set out below.

In U.S. Pat. No. 2,137,700, F. W. Reehl discloses a garment hanger with two pivoted arms with respect to one another under the control of a tensioner that tends to spread the arms from a partially closed or collapsed position into a garment supporting position. Reehl's tensioner acts to collapse the arms when pressure is applied thereto.

In U.S. Pat. No. 2,728,499, H. F. Mueller discloses a garment hanger with two arms pivoted at their midpoint. The type of hanger proposed by Mueller is complex and does not allow for single hand use to collapse and to restore the hanger shape for use.

In U.S. Pat. No. 2,926,823, M. Weiser discloses a garment hanger with at least one separable shoulder portion for use with garments having small or restricted tops or hanger receiving openings. This type of hanger is not adapted for single hand use and has a somewhat complex mode of operation.

In U.S. Pat. No. 3,531,028, F. B. Vazquez discloses a collapsible clothes hanger having arms that may be flexed to an unfolded position for hanging garments or to a folded position for storage when the hanger is not in use. This type of hanger requires the action of two hands to fold and unfold and does not include biasing means to position the arms into position for use in hanging garment.

In U.S. Pat. No. 4,227,632, J. H. Collis discloses a flexible garment hanger formed of a one-pieced, molded plastic-like material with several flexible hinges. There is found a locking bar below the body of the hanger secured to both arms by means of similar flexible hinges and a stop member projecting medially from the locking bar with two additional flexible hinges. This type of hanger requires two hands to operate and does not allow the hanger shoulder members to open automatically once the hanger has been inserted in the piece of garment.

In U.S. Pat. No. 4,813,581, R. M. LaMont discloses a unitary collapsible hanger formed of plastic that includes hinged locking hanger arms attached to a hook by plastic hinges. LaMont includes a C-shaped spring element. This type of hanger when in a collapsed position has a spring which is in its relaxed configuration and the pivot is disposed below the spring hinges. When his hanger is in the garment supporting position, the pivot is above the spring hinges and engages a stop member so that bearing surfaces engage shoulders of the stop member to lock the hanger in its garment supporting position. This type of hanger has many pivot points which increase the possibility of breakage and is further not adapted for single hand use.

In U.S. Pat. No. 5,590,823, Lunde discloses a collapsible garment hanger which includes a hook, a first and second tensioning element which extend from the hook, the first and second tensioning elements being terminated with a first and second distal tip, respectively. A first and second shoulder element each having a first end and a substantial middle region, the first ends of the first and second shoulder elements being pivotally connected and rotate in relation to each other, the substantially middle region of the first and second shoulder elements having a hole which accepts the first and second distal tips, respectively. The first and second shoulder elements pivot in relation to the first and second tensioning elements, respectively. With this type of hanger the user must grasp both first and second tensioning elements and compress them toward each other to force the first and second shoulder elements into a collapsed position for insertion or removal from a small opening in a garment. However, Lunde fails to mention that the pin does not prevent the hanger for folding in the wrong position.

In U.S. Pat. No. 5,979,721 J. A. Curtis discloses a garment hanger having downwardly foldable, pivoted arms uses a spring between the pivoted arms which is compressed when the pivoted arms are in an operative position and a preferably slidable switch/control latch to control off-axis movement of a central portion of the spring to positively control movement of the pivoted arms between an operative position and a folded position and vice-versa. This hanger is cumbersome and the slideble latch is inconvenient for the operation.

In U.S. Pat. No. 6,540,121 K. A. Harvey discloses collapsible hanger is which is a one-piece molded structure that includes a hook, two arms, at least one spring element, and in some versions, a base. The various hangers provided by Harvey are too flimsy to support a garment with a substantial weight while those adapted to hold substantial weight can not be operated with one hand.

In U.S. Pat. Des. 271,927 N.M. Payant discloses a folding garment hanger. However this hanger is not adapted for single hand use.

In light of the state of the art of collapsible garment hangers, there is still a need for an inexpensive collapsible hanger which has a simple mechanism preferably operable by a single hand and which is cheap to manufacture.

It is therefore a primary object of the invention to provide such a hanger. Further and other objects of the invention will become apparent to one skilled in the art when considering the following summary of the invention and the more detailed description of the preferred embodiment illustrated herein.

SUMMARY OF THE INVENTION

According to one aspect of the invention there is provided a collapsible garment hanger comprising:

i) a central portion including,
   a) a top portion with a hanger support such as for example a hook or pin for engaging a garment support
   b) a bottom portion,
   c) and two outer parts containing a pivot;

ii) two garment supporting members, each having:
   a) a first outer end; and a second inner end, provided proximate the first outer end, a garment supporting arm, and having disposed proximate the second inner end a pivot engaging part, wherein said garment supporting members are connected to the pivot and are moveable in relation to the central portion;

preferably, said outer parts of said central portion contain said pivot while said bottom portion of the central portion being operably connected to the pivot and movably engaged with the garment supporting members;

preferably, the bottom portion of said central portion is adapted to move from a first position wherein the garment supporting members extend laterally away from the central portion, to a second position whereat the outer ends of the garment supporting members extend generally downwardly away from the central portion;

preferably the bottom portion of the central portion is a u-shaped member operably connected to the two garment supporting members, while said u-shaped member having disposed proximate each leg of said u-shape a detent to engage with the two garment supporting members;

preferably the two outer parts of the central portion further comprises at least one pin adapted to receive the u-shaped member.

Preferably the two outer parts of the central portion comprises two pins adapted to receive the u-shaped member.

Preferably the collapsible garment hanger incorporates a spring and this spring biases the garment supporting members away from one another. The spring may be of any kind known to the person skilled in the art.

Preferably the collapsible garment hanger is adapted to allow movement of the u-shaped member from a first position where the u-shaped member is away from the pivot to a second position wherein the u-shaped member is adjacent the pivot.

Further preferably the collapsible garment hanger is adapted for single hand use.

Further preferably the outer parts of said central portion of the collapsible garment hanger are adapted to prevent an overextension of the garment supporting members when they are extending away from one another.

Also preferably the collapsible hanger contains at least one locking member which is adapted to secure the garment supporting members in the position when the garment supporting members are extended away from one another. The locking member may be of any type of hook, pin, and lock or like known to the person skilled in the art.

According to yet another aspect of the invention there is provided a collapsible garment hanger comprising:

i) a central portion including:
   a) a top portion with a hanger support for engaging a garment support;
   b) a u-shaped bottom member,
   c) two outer parts containing a pivot
   d) a spring;
ii) two garment supporting members, each having:
   a) a first outer end comprising a supporting arm,
   b) a second inner end comprising a pivot engaging part and a cam surface.

Preferably said garment supporting members being connected to the pivot and engaged with one another via a spring and are moveable in relation to the central portion. The outer parts of said central portion containing said pivot and further containing at least one pin and are adapted to engage the u-shaped member. Further the u-shaped member is operably connected to the pivot and movably engaged with two garment supporting members. The u-shaped member having disposed proximate each leg of said u-shape a detent to engage with the two garment supporting members at their corresponding cams.

Preferably said u-shaped member is adapted to move from a first position wherein the garment supporting members extend laterally away from the central portion, to a second position whereat the outer ends of the garment supporting members extend generally downwardly away from the central portion. While the u-shaped member is moving from the first position toward the second, the detents apply a force on the cams, forcing the garment supporting members to move to the second position.

Further preferably the collapsible hanger contains at least one locking member described above, which is adapted to secure the garment supporting members in the first position wherein the garment supporting members extend away from one another.

DESCRIPTION OF THE PREFERRED EMBODIMENT OF THE INVENTION

The present invention is generally related to the garment hangers, and more specifically to collapsible garment hangers. The following description, taken in conjunction with the referenced-drawings, is presented to enable one of ordinary skill in the art to make and use the invention and to incorporate it in the context of particular applications. Various modifications, as well as a variety of uses in different applications, will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein. Furthermore it should be noted that unless explicitly stated otherwise, the figures included herein are illustrated diagrammatically and without any specific scale, as they are provided as qualitative illustrations of the concept of the present invention.

One version of the collapsible hanger provided in FIGS. 1-7.

Figure 1:
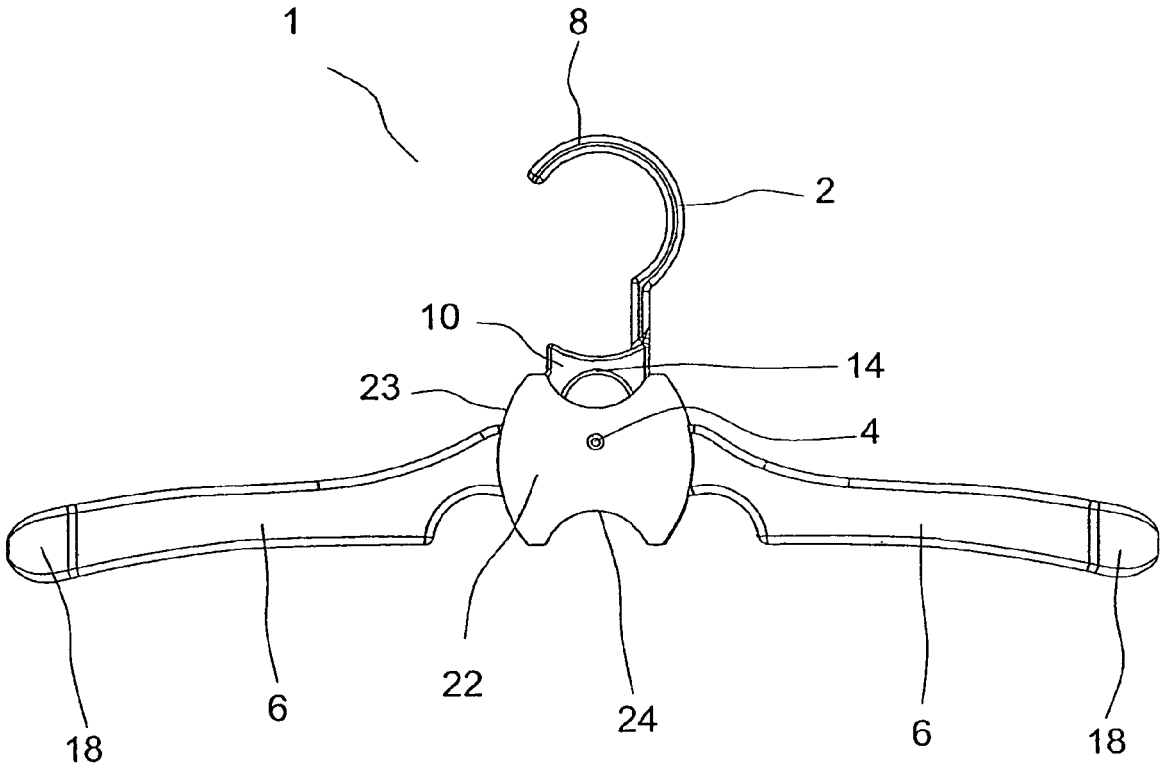
FIG. 1 is a side view of the collapsible garment hanger according to the present invention wherein the garment supporting members are away from one another.

The present invention provides in FIG. 1 a collapsible garment hanger (1) having: a top portion (2) extending upward from a pivot (4); and two garment supporting members (6) extending laterally from the pivot (4) and moveable in relation to the top portion (2). The top portion (2) has a hook (8) at a top section thereof; and a u-shaped member (10) at a bottom section thereof operably connected to the pivot (4), said u-shaped member (10) has at a first extremity two detents (12) which are connected together at another extremity of the u-shaped member (10) through a U-shaped portion (14). The u-shaped member (10) is adapted to move from a first position where the U-shaped portion (14) is away from the pivot (4) to the second position wherein the U-shaped portion (14) is adjacent the pivot (4).

The two garment supporting members (6) each have an inner extremity (16) and an outer extremity (18) which serves as a garment supporting arm. The two garment supporting members (6) are hingeably connected to one another at their inner extremity (16) to the pivot (4). The top portion (2) is slideable from a first position where the garment supporting members (6) are spread apart from one another to a second position where the garment supporting members (6) are substantially extending in the same direction as they are, in essence, collapsed in a folded position in relation to the pivot (4).

The garment supporting members (6) are biasedly mounted away from one another by biasing means, preferably by the use of a spring (20) or the like. The garment hanger (1) comprises two outer parts (22 and 22') harboring the pivot (4). Further on the combination of those two outer parts is referred as a casing (23). Preferably, the casing (23) is adapted to allow movement of the two garment supporting members (6) from the first position, extending outwardly from one another, to the second position where they extend in substantially the same direction.

The casing (23) is adapted to allow movement of the u-shaped member (10) from a first position wherein the U-shaped portion (14) of the u-shaped member (10) is adjacent the pivot (4) and a second position where the U-shaped portion (14) of the u-shaped member (10) is away from the pivot (4).

The collapsing hanger (1) is adapted for single hand use, since the operator may place one finger inside the top portion (2) and one finger opposite the first finger on the portion (24) of the casing (23) opposite the top portion (2).

Figure 2:
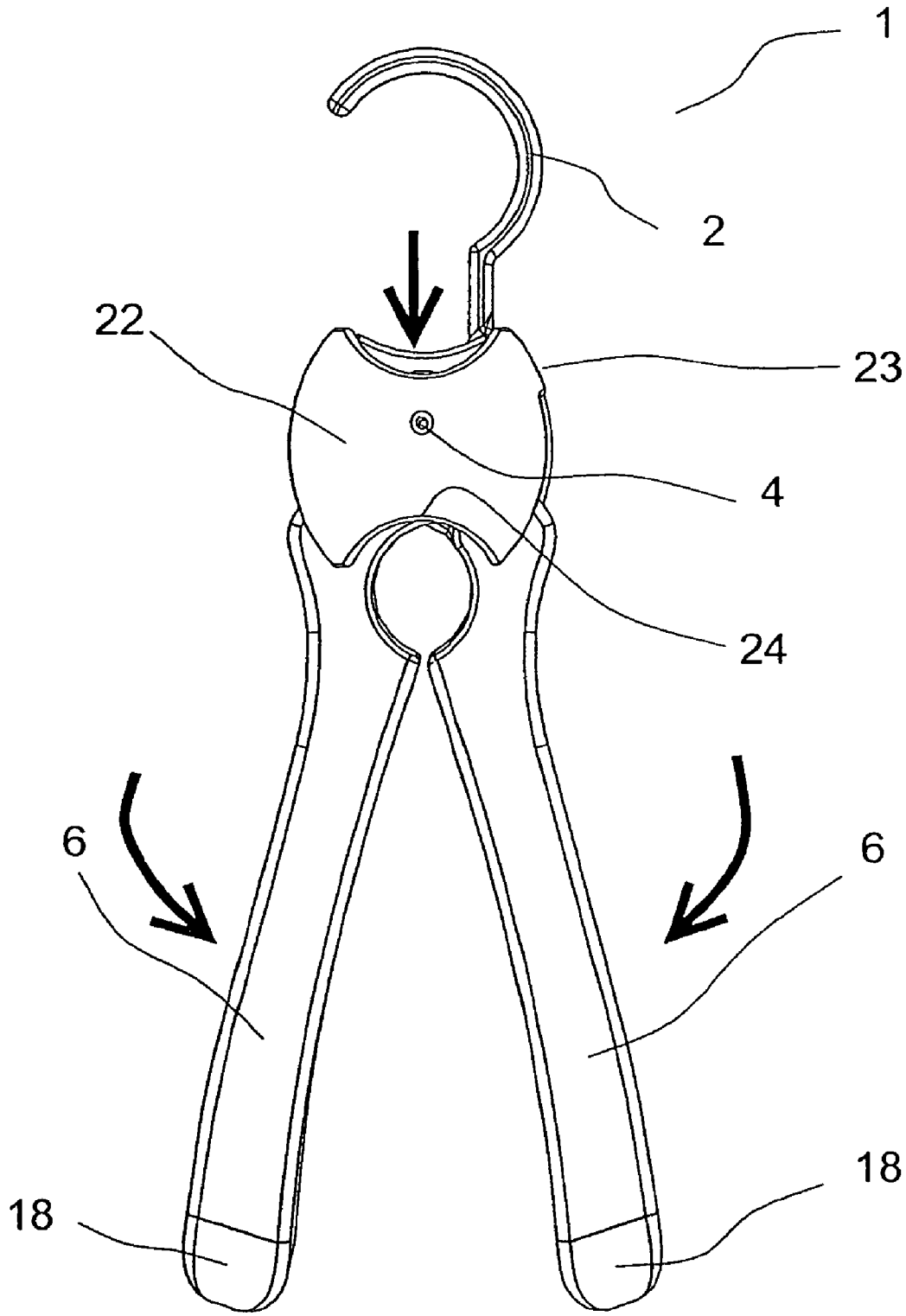
FIG. 2 is a side view of the collapsible garment hanger according to the present invention wherein the garment supporting members are in a partially collapsed position.

By referring to FIG. 2, in depressing the u-shaped member (10) one collapses the two garment supporting member (6) towards one another and allows very easy insertion of the collapsed garment hanger (1) into a piece of garment. Once the collapsed garment hanger (1) is inserted into the garment, releasing the pressure on the fingers allows the U-shaped portion (14) of the u-shaped member (10) to move away from the pivot (4) and thereby allow the garment supporting members (6) to return to the first position where they extend laterally away from the pivot (4) and away from one another.

Preferably, the casing (23) is adapted to prevent overextension of the shoulder members (6) when they are spread apart from one another (when they extend laterally away from each other). Also, preferably the casing is adapted to maintain the detents (12) of the u-shaped member (10) in contact with the two shoulder members (6). Preferably, the garment supporting members (6) are in constant contact with the spring (20).

Preferably, the casing (23) has slots (not shown) adapted to receive the u-shaped member (10) which allows the u-shaped member to slide smoothly from the first position where the U-shaped portion (14) adjacent the pivot (4) and the second position where the U-shaped portion (14) is away from the pivot (4).

Also preferably, the detents (12) may be adapted to have protrusions (26) on their sides to help in maintaining the u-shaped member (10) inside the casing (23).

Figure 3:
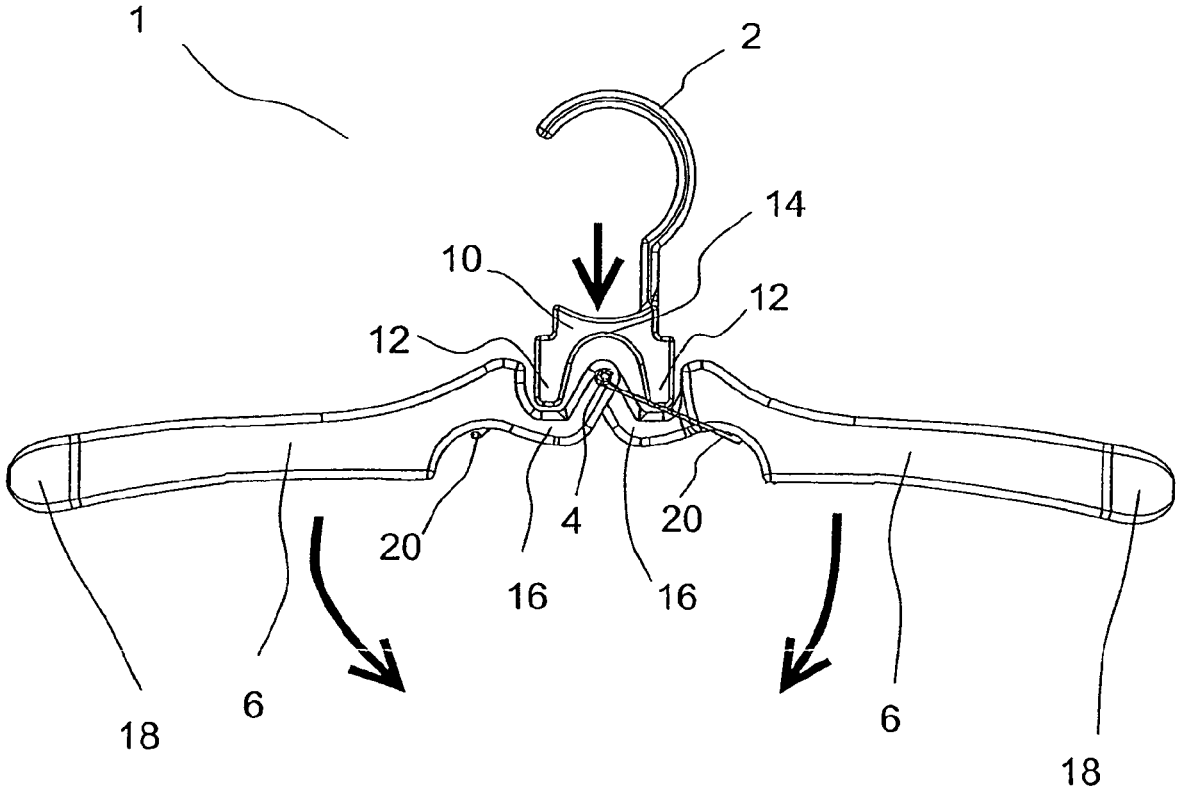
FIG. 3 is a cut side view of the collapsible garment hanger according to the present invention wherein the garment supporting members are away from one another and the interior of the casing is shown.

By referring to FIG. 3, the inner workings of the garment hanger (1) are revealed by the omission of the outer part (22'). The arrows showing that depressing the u-shaped member (10) will collapse the garment supporting members (6) towards one another to facilitate the insertion of the garment hanger (1) into a garment.

Figure 4:
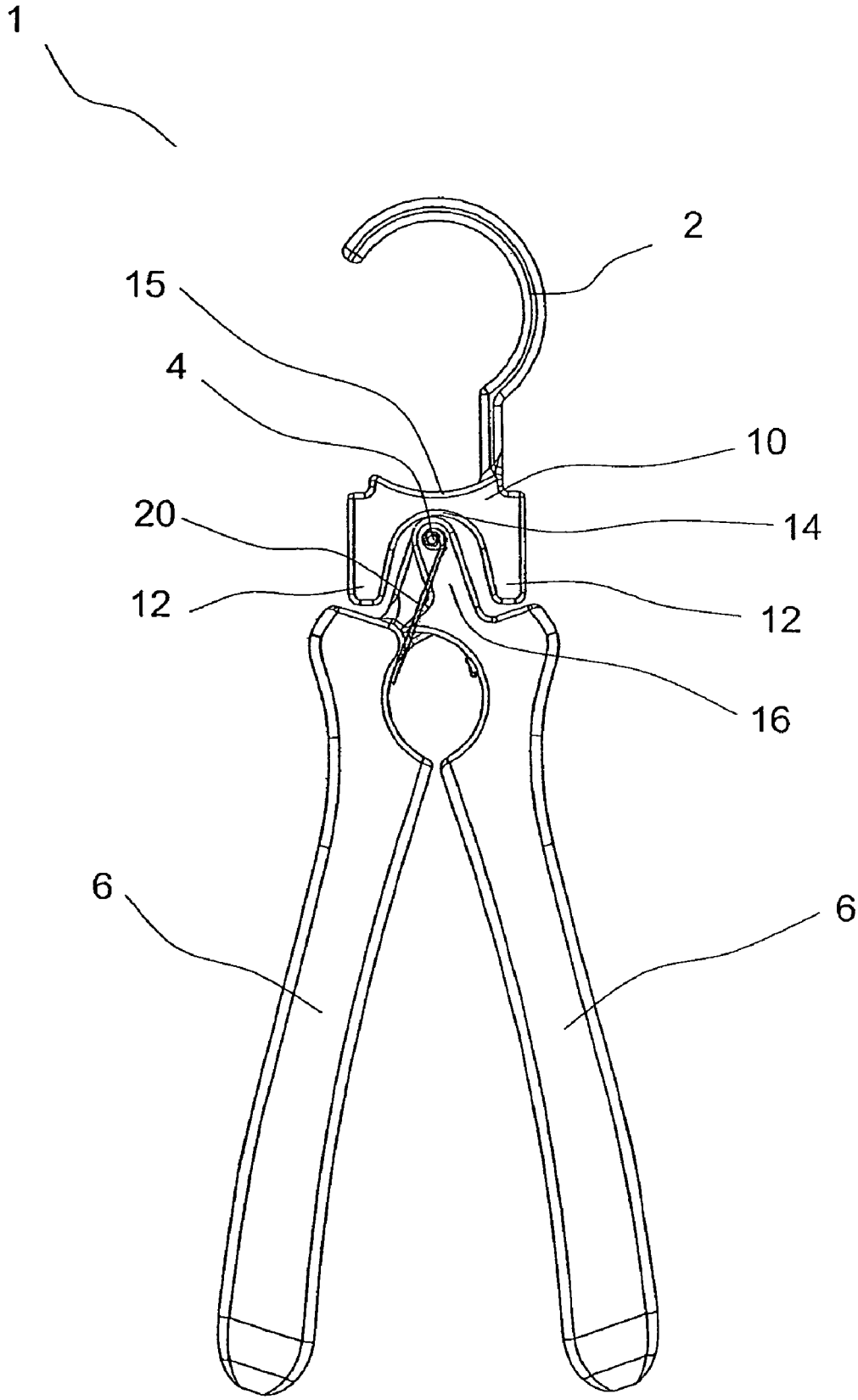
FIG. 4 is a side view of the garment hanger according to the present invention without the casing when the garment supporting members are substantially extending in the same direction.

By referring to FIG. 4, one skilled in the art will note that the u-shaped member (10) has its U-shaped portion (14) adjacent against the pivot (4) and the two detents (12) each facing the garment supporting members (6) downwards in a position where both members (6) are extending substantially in the same direction.

Figure 5:
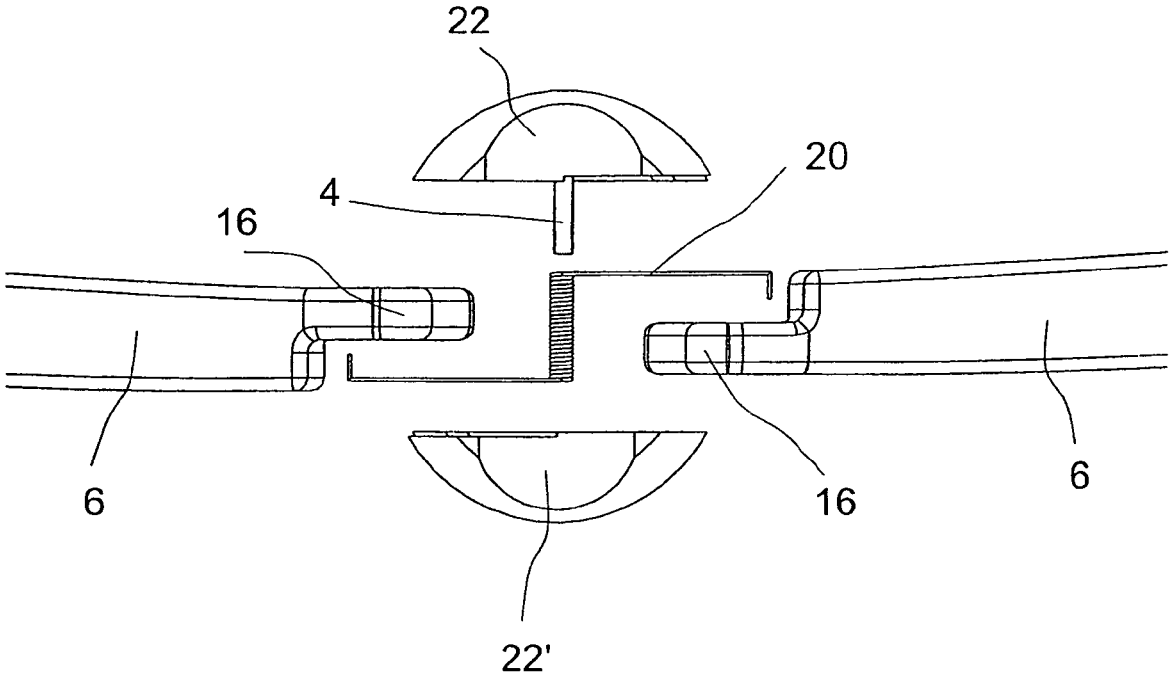
FIG. 5 is a view from above of the pivot without the casing showing when the garment supporting members are extending substantially away from one another.
Figure 6:
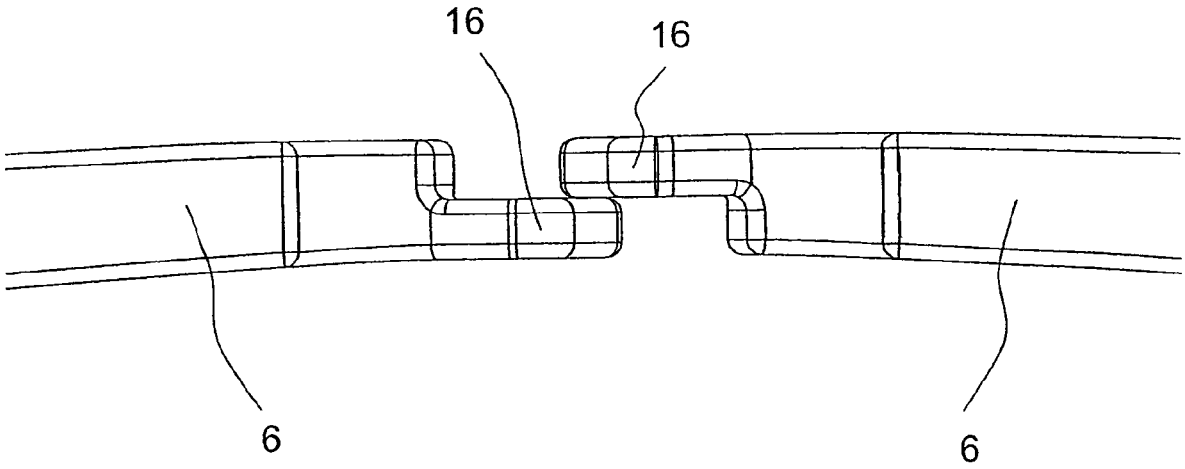
FIG. 6 is a view from under of the pivot without the causing showing when the garment supporting members are extending substantially away from one another.

By referring to FIGS. 5 and 6, the arrangement of the interconnection between the pivot (4), the two garment supporting members (6) and the spring (20) becomes apparent both when viewing the arrangement from above (FIG. 5) and from underneath (FIG. 6).

Figure 7:
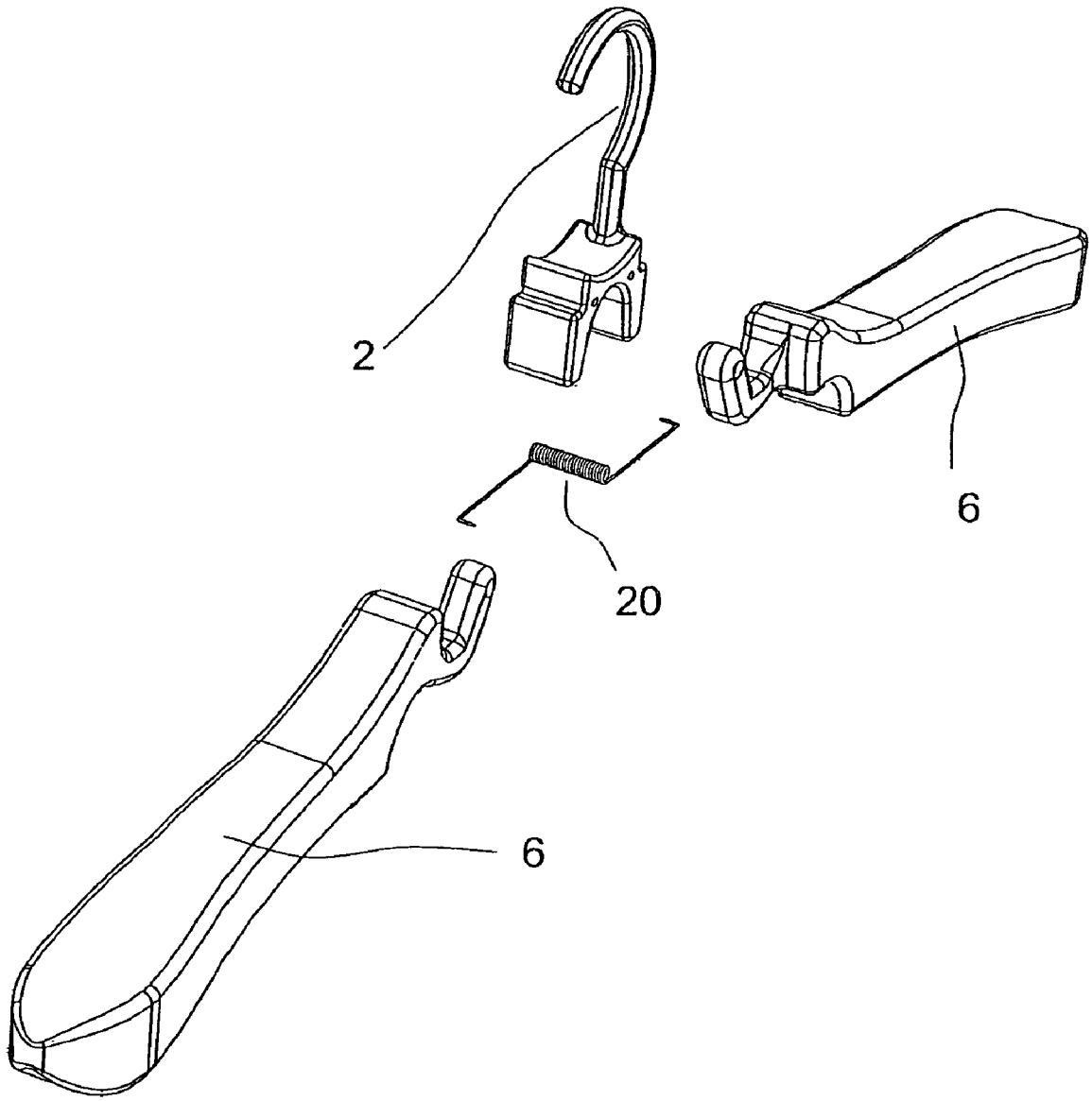
FIG. 7 is an exploded perspective view of pivot of the garment hanger according to the present invention, the two garment supporting members, the spring and the u-shaped member.

FIG. 7 provides another look at the interconnection between the garment supporting members (6), the spring (20) and the top portion (2) in an exploded view.

Another embodiment of the invention is further provided in the FIGS. 8-14.

Figure 8:
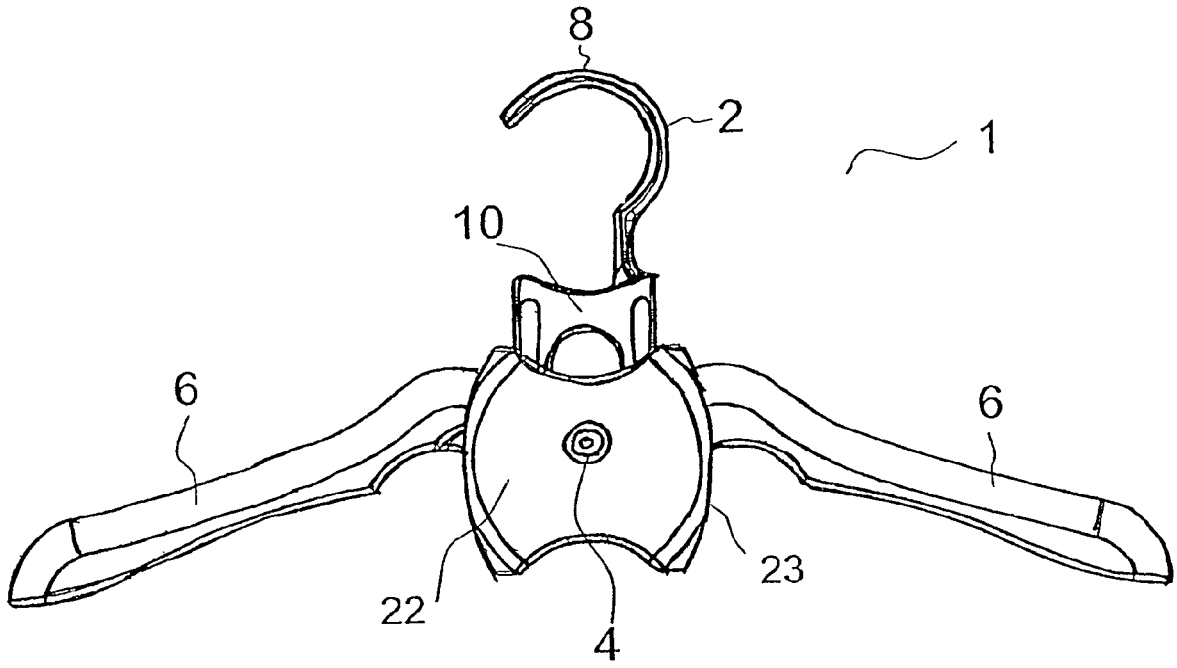
FIG. 8 is a front view of the collapsible garment hanger according to the present invention wherein the garment supporting members are away from one another.

The present invention provides in FIG. 8 a collapsible garment hanger (1) having: a central portion comprising a top portion (2) with a hook (8), a bottom u-shaped member (10) and two outer parts (22) and (22') comprising a pivot (4), those two outer parts are furthered referred as casing (23); and two garment supporting members (6) extending laterally from the pivot (4) and moveable in relation to the central portion. The top portion (2) has a hook (8) at a top section thereof; and a unshaped member (10) at a bottom section thereof operably connected to the pivot (4).

Figure 9:
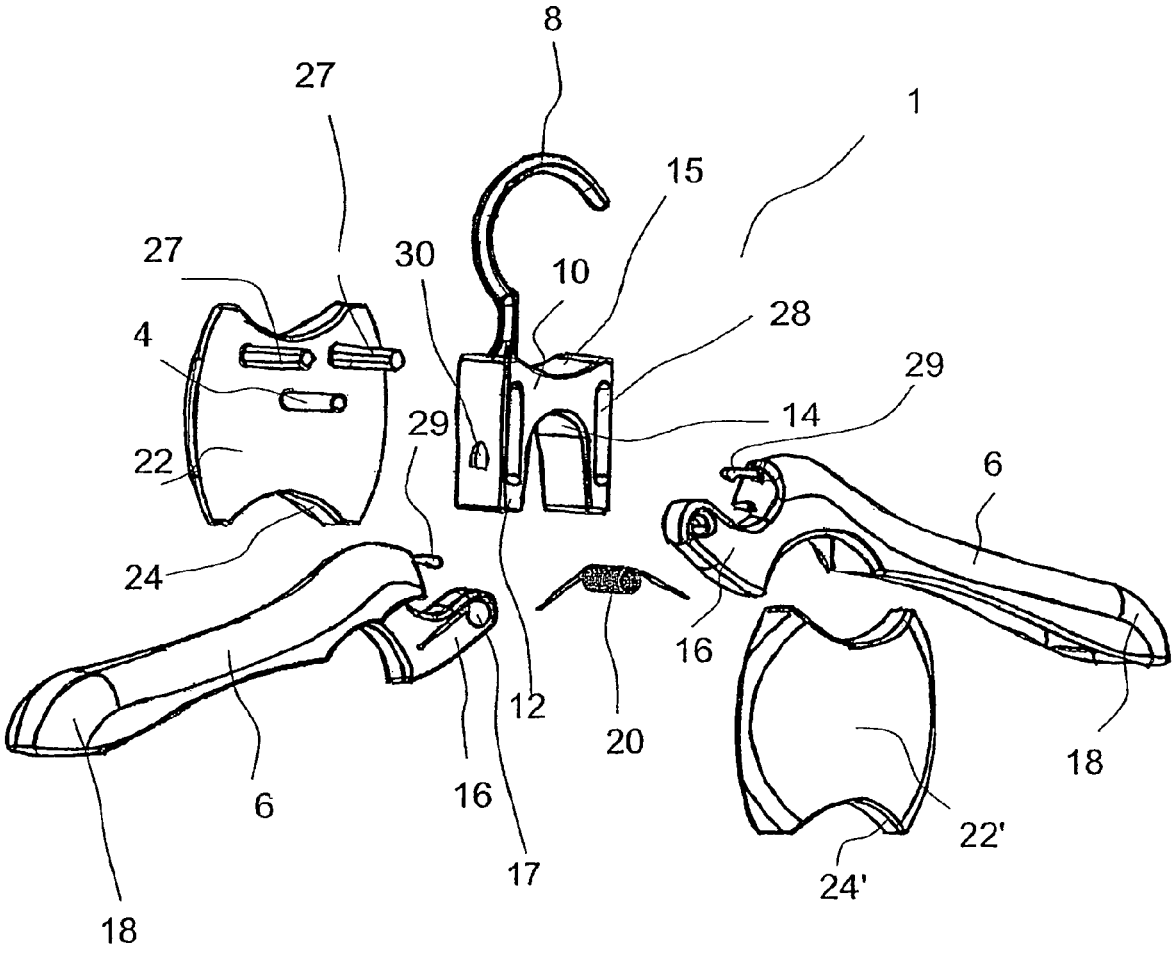
FIG. 9 is an exploded perspective view of the collapsible garment hanger according to the present invention including casing, biasing means, two garment supporting members and the central portion with the u-shaped member.
Figure 10:
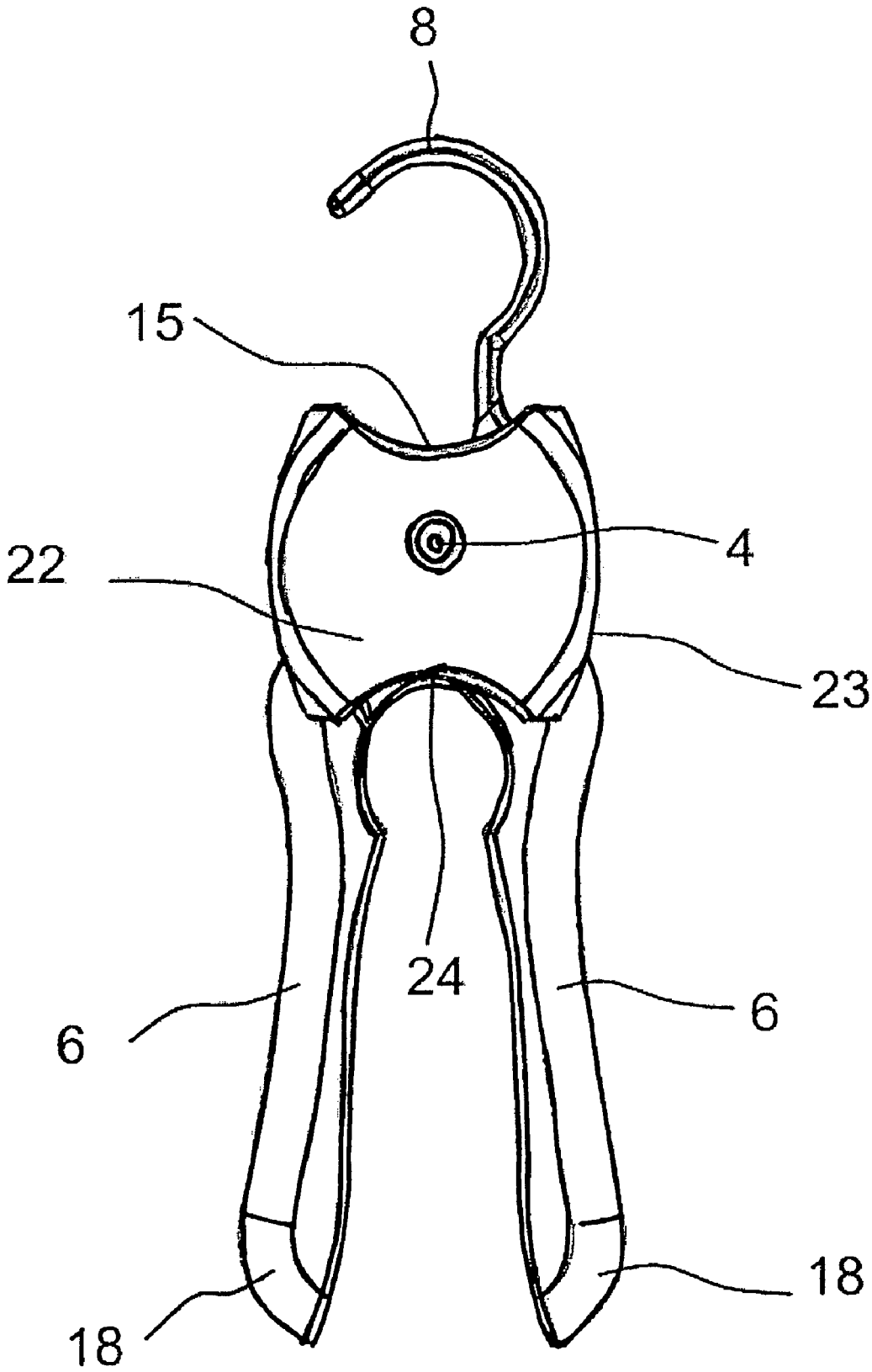
FIG. 10 is a front view of the collapsible garment hanger according to the present invention wherein the garment supporting members are in a collapsed position.

By referring to FIG. 9 which illustrates the exploded view of the invention, it is shown that the, u-shaped member (10) has at a first extremity two detents (12) which are connected together at another extremity of the u-shaped member (10) through a U-shaped portion (14) The u-shaped member (10) is adapted to move from a first position wherein the U-shaped portion (14) is away from the pivot (4) and a second position where the U-shaped portion (14) is adjacent the pivot (4).

Each of the two garment supporting members (6) has an inner extremity (16) comprising a pivot engaging part (17) and an outer extremity comprising a garment supporting arm (18). The two garment supporting members (6) are hingeably connected to one another at their inner extremity (16) to the pivot (4). The u-shaped member (10) is slideable from a first position where the garment supporting members (6) are spread apart from one another (see FIG. 8) to a second position where the garment supporting members (6) are substantially extending in the same direction as they are, in essence, collapsed in a folded position in relation to one another (See FIG. 10).

The garment supporting members (6) are biasedly mounted away from one another by biasing means, preferably by the use of a spring (20) or the like. The garment hanger (1) comprises a casing (23) harboring the pivot (4). Preferably, the casing (23) is adapted to allow movement of the two garment supporting members (6) from the first position, extending outwardly from one another, to the second position where they extend in substantially the same direction.

Figure 11:
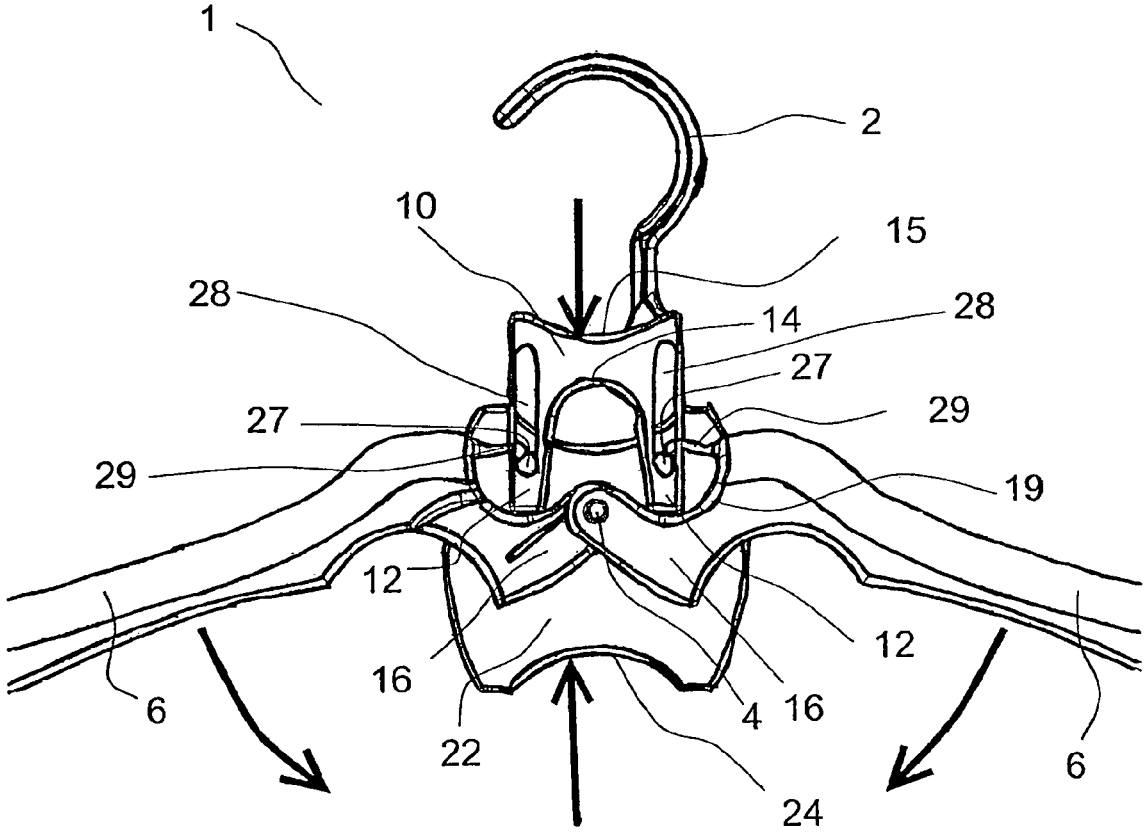
FIG. 11 is a cut front view of the collapsible garment hanger according to the present invention wherein the garment supporting members are away from one another and the interior of the casing is shown.
Figure 12:
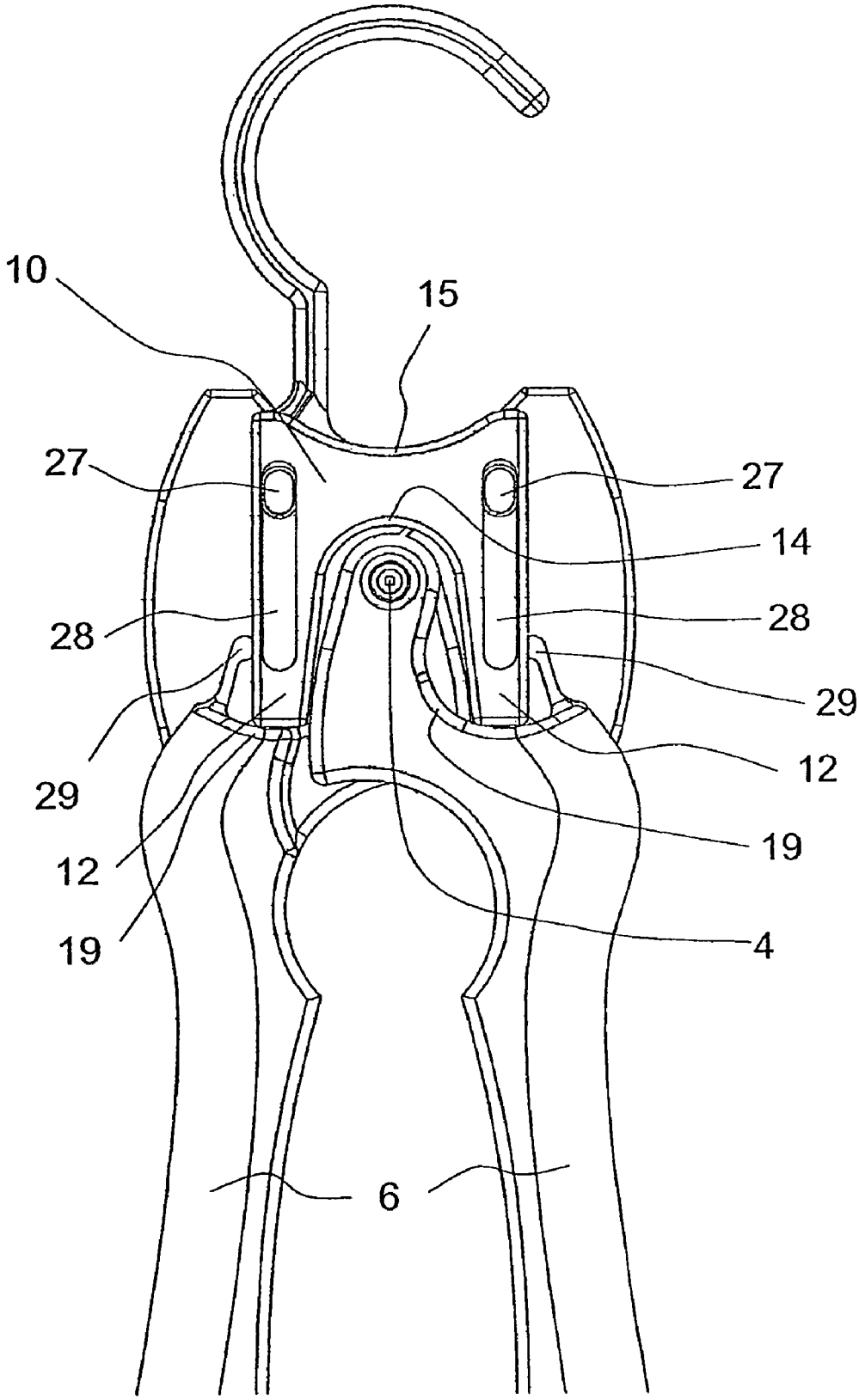
FIG. 12 is a back view of the garment hanger according to the present invention without the casing when the garment supporting members are substantially extending in the same direction and the interior of the casing is shown.

Further, the casing (23) is adapted to allow movement of the u-shaped member (10) from a first position wherein the U-shaped portion (14) of the u-shaped member (10) is a way from the pivot (4) (see FIG. 11)—and a second position where the U-shaped portion (14) of the u-shaped member (10) is adjacent the pivot (4) (See FIG. 12).

The casing (22) is adapted for single hand use, since the operator may place one finger on the portion (15) of the u-shaped member (10) and another finger opposite the first finger on the portion (24) of the casing (23) opposite the portion (15)

By referring to FIG. 11, in depressing the portion (15) toward the casing portion (24) one collapses the two garment supporting member (6) towards one another and allows very easy insertion of the collapsed garment hanger (1) into a piece of garment. Once the collapsed garment hanger (1) is inserted into the garment, releasing the pressure on the fingers allows the U-shaped portion (14) of the u-shaped member (10) to move away from the pivot (4) and thereby allow the garment supporting members (6) to return to the first position where they extend laterally away from the pivot (4) and away from one another (See FIG. 8).

Further the casing (23) is preferably adapted to prevent overextension of the garment supporting members (6) when they are spread apart from one another (when they extend laterally away from each other). Also, preferably the casing is adapted to maintain the detents (12) of the u-shaped member (10) in contact with the two cam surfaces (19) of the garment supporting members (6) at their end (16). Preferably, the garment supporting members (6) are in constant contact with the spring (20).

Preferably, the casing (23) further comprises pins (27) adapted to receive the slots (28) of the u-shaped member (10) which allows the u-shaped member to slide smoothly from the first position where the U-shaped portion (14) is away from the pivot (4) and the second position where the U-shaped portion (14) is adjacent the pivot (4).

The collapsible garment hanger further preferably comprises a locking member (29) best seen in FIG. 9. This locking member (29) in its operable position (see FIG. 11) engages locking slot (30) (best seen in FIG. 9), and prevents collapsing of the garment supporting members (6) as a result of the weight of the garment. The locking member is released by the movements of the pins (27) when the operator depresses the u-shaped member (10) toward the casing (22), as illustrated in FIG. 4. Pins (27) push the locking pins (29) from the locking slot (30) to their unlocked position illustrated in FIG. 12; when operator releases the pressure and the collapsible hanger returns to the fully extended position (FIG. 11) the locking pin (29) slips into the locking slot (30), and further holds the supporting members in this position.

Further in the FIG. 11 one skilled in the art will note that the locking pins (29) are engaged with the locking slots (30).

By referring to FIG. 12, one skilled in the art will note that the u-shaped member (10) has its U-shaped portion (14) adjacent the pivot (4) and the two detents (12) each facing the garment supporting members (6) downwards in a position where both members (6) are extending substantially in the same direction. Further the locking pins (29) are disengaged from the locking slots (30). While the operator depress the portion (15) toward the portion (24) as it illustrated in FIG. 11, the detents (12) of the u-shaped member (10) apply force on the cam surfaces (19) providing the garment supporting members (6) rotational motion around the pivot (4) as a result the members (6) collapse and extend in the same direction as illustrated in the FIG. 12

Figure 13:
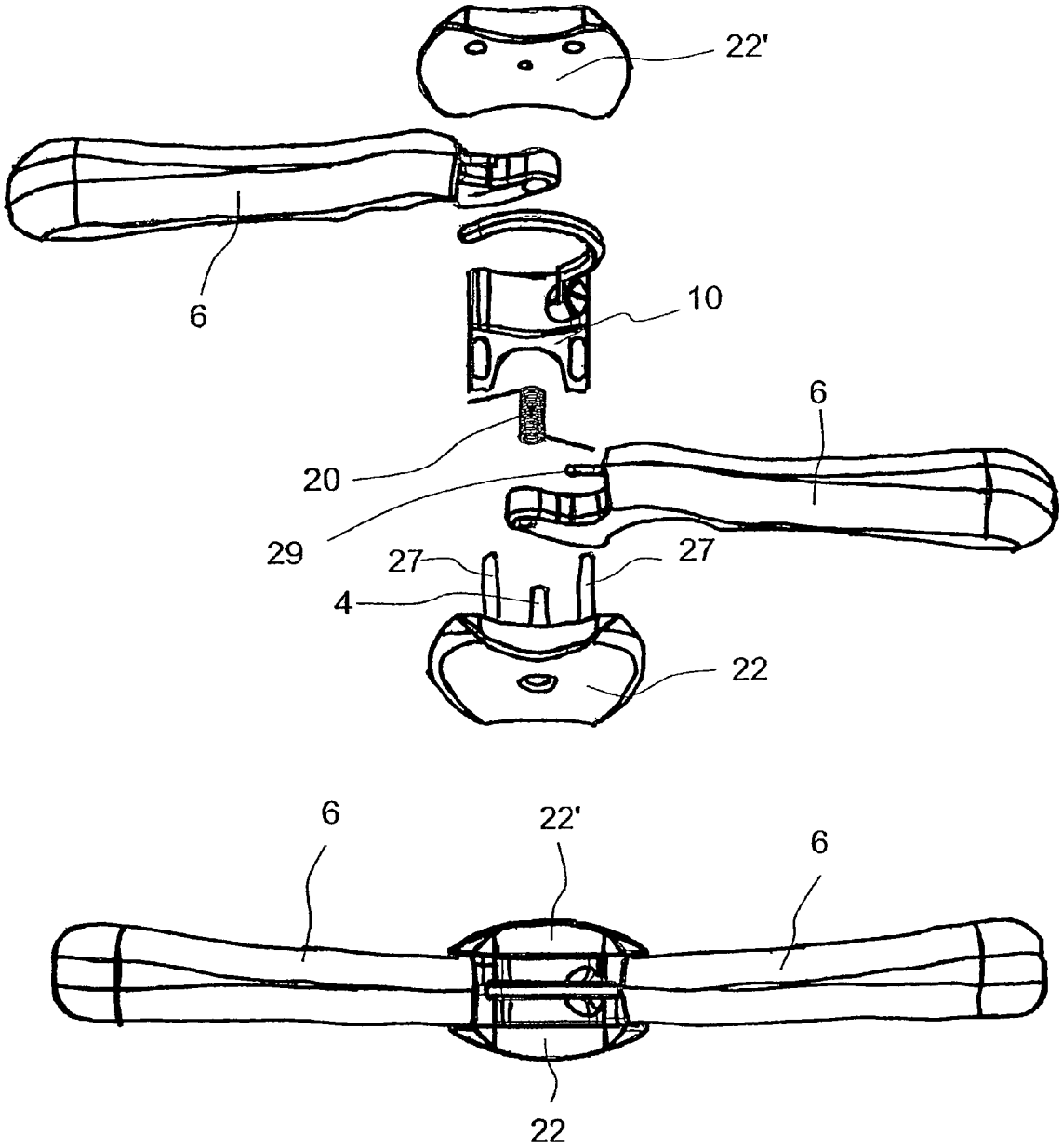
FIG. 13 is an exploded and fully assembled view of the present invention from above when the garment supporting members are extending substantially away from one another.
Figure 14:
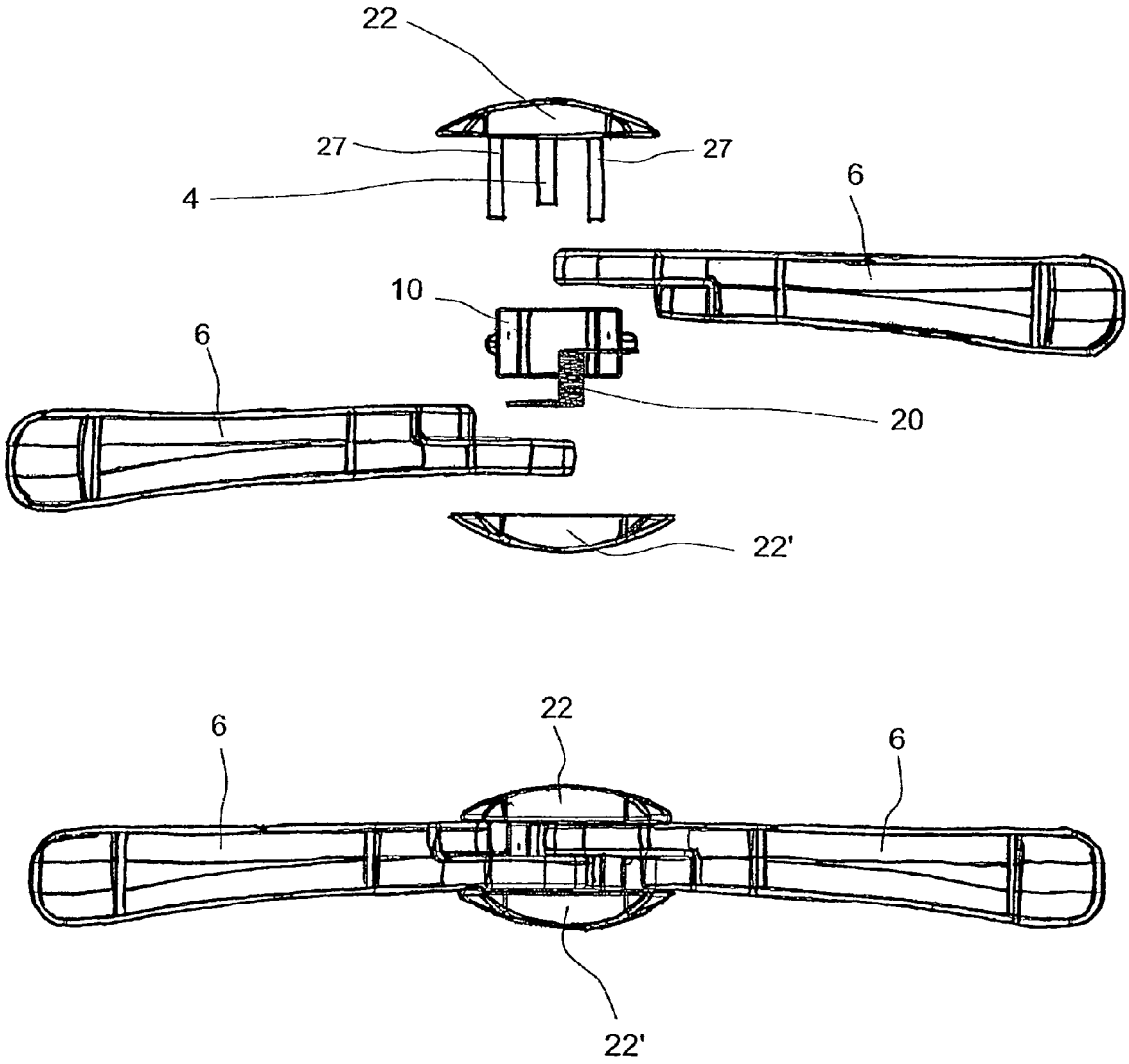
FIG. 14 is an exploded and fully assembled bottom view of the present invention from below when the garment supporting members are extending substantially away from one another.

By referring to FIGS. 13 and 14, the arrangement of the interconnection between the pivot (4), the two garment supporting members (6) and the spring (20) becomes apparent both when viewing the arrangement from above (FIG. 13) and from underneath (FIG. 14) in both exploded and fully assembled views.

As many changes can be made to the present invention without departing from the scope of the invention, it is intended that all matter contained herein be considered illustrative of the invention and not in a limiting sense.

The invention claimed is:

1. A collapsible garment hanger comprising a central portion and two garment supporting members:

the central portion including:

a) a top portion with a hanger support for engaging a garment support and also including legs engaging the garment supporting members;

b) and a casing containing a pivot;

said two garment supporting members, each having:

a first outer end; and a second inner end and having provided proximate the first outer end, a garment supporting arm, and having disposed proximate the second inner end a pivot engaging part, said garment supporting members being connected to the pivot and are moveable in relation to the central portion;

the legs of said top portion being operably connected to the pivot and movably engaged with the garment supporting members, wherein said top portion of said central portion is adapted to move inside the casing from a first position wherein the garment supporting members extend laterally away from the central portion, to a second position whereat the outer ends of the garment supporting members extend generally downwardly away from the central portion.

2. The collapsible garment hanger according to claim 1, wherein said top portion of the central portion is a u-shaped member operably connected to the two garment supporting members, said u-shaped member having disposed proximate each leg of said u-shape a detent to engage with the two garment supporting members.

3. A collapsible garment hanger comprising:

i) a central portion including:

a) a u-shaped member with a hanger support for engaging a garment support;

b) a two part casing containing a pivot;

ii) two garment supporting members, each having:

a first outer end; and a second inner end, and having provided proximate the first outer end, a garment supporting arm, and having provided proximate the second inner end a pivot engaging part, said garment supporting members being connected to the pivot and are moveable in relation to the central portion, said u-shaped member being operably connected to the pivot and movably engaged with two garment supporting members, said u-shaped member having disposed proximate each leg of said u-shape a detent to engage with the two garment supporting members, said u-shaped member is adapted to move inside the casing from a first position wherein the garment supporting members extend laterally away from the central portion, to a second position whereat the outer ends of the garment supporting members extend generally downwardly away from the central portion.

4. A collapsible garment hanger according any one of claim 1 or 3, wherein the casing further comprises at least one pin adapted to engage the u-shaped member.

5. A collapsible garment hanger according to claim 4 wherein the pivot incorporates a spring and said spring biases the garment supporting members away from one another.

6. A collapsible garment hanger of claim 5 adapted to allow movement of the u-shaped member from a first position where the u-shaped member is away from the pivot to a second position wherein the u-shaped member is adjacent the pivot.

7. A collapsible garment hanger according to claim 6 wherein the collapsible garment hanger is adapted for single hand use.

8. A collapsible garment hanger according to claim 7 adapted to prevent an overextension of the garment supporting members when they are extending away from one another.

9. A collapsible hanger according to claim 8 containing at least one locking member which is adapted to secure the garment supporting members in the position when the garment supporting members are extended away from one another.

10. A collapsible garment hanger comprising:

i) a central portion including, a) a u-shaped top portion with a hanger support for engaging a garment support;

b) a two part outer casing containing a pivot c) a spring;

ii) two garment supporting members, each having:

a) a first outer end comprising a supporting arm, b) a second inner end comprising a pivot engaging part and a cam surface, said garment supporting members being connected to the pivot and engaged with one another via a spring and are moveable in relation to the central portion;

said outer casing parts of said central portion containing said pivot and further containing at least one pin and are adapted to engage the u-shaped member, said u-shaped member being operably connected to the pivot and movably engaged with two garment supporting members, said u-shaped member having disposed proximate each leg of said u-shape a detent to engage with the two garment supporting members at their corresponding cams;

wherein said u-shaped member is adapted to move inside the casing from a first position wherein the garment supporting members extend laterally away from the central portion, to a second position whereat the outer ends of the garment supporting members extend generally downwardly away from the central portion, whereat said detents apply a force on the cams, forcing the garment supporting members to move to the second position.

11. A collapsible hanger according to claim 10 containing at least one locking member which is adapted to secure the garment supporting members in the first position wherein the garment supporting members are extended away from one another.

* * * * *